US006571930B2

(12) United States Patent
Li et al.

(10) Patent No.: US 6,571,930 B2
(45) Date of Patent: Jun. 3, 2003

(54) COIN MECHANISM FOR VENDING MACHINE

(75) Inventors: Yang Yao Li, Shen Zhen (CN); Lian He Huo, Shen Zhen (CN); Ming Ip, Flushing, NY (US)

(73) Assignee: Fortune Resources, Inc., Jersey City, NJ (US)

( * ) Notice: Subject to any disclaimer, the term of this patent is extended or adjusted under 35 U.S.C. 154(b) by 100 days.

(21) Appl. No.: 09/793,824

(22) Filed: Feb. 26, 2001

(65) Prior Publication Data

US 2002/0117374 A1 Aug. 29, 2002

(51) Int. Cl.[7] ..... G07F 5/02
(52) U.S. Cl. ..... 194/232
(58) Field of Search ..... 194/232, 237, 194/238, 247

(56) References Cited

U.S. PATENT DOCUMENTS 1,882,506 A * 10/1932 Knee ..... 194/247
2,606,977 A * 8/1952 Gizzo ..... 194/247
4,034,840 A * 7/1977 Reitman ..... 194/234
4,153,150 A * 5/1979 Barth et al. ..... 194/237
4,363,393 A * 12/1982 McDonald ..... 194/237
5,715,925 A * 2/1998 Tomioka ..... 194/237

* cited by examiner

*Primary Examiner*—Donald P. Walsh
*Assistant Examiner*—Mark J. Beauchaine
(74) *Attorney, Agent, or Firm*—Gibbons, Del Deo, Dolan, Griffinger & Vecchione

(57) ABSTRACT

A coin mechanism for use with a vending machine where there is a coin barrel that receives the particular coins inserted vertically downwardly by the customer into a coin receiver. The coin barrel has an outer position where the coins can be inserted into the coin receiver and an inner position where the coins are checked by a coin discriminating mechanism, and, if proper, will allow the coin barrel to be rotated further by the customer to activate the vending machine to release the particular selected product. In the even the customer has made a mistake or has had a change of mind, the coin barrel is also allowed to be rotated by the customer, when in its outer position, to a position where the coin receiver is facing substantially downwardly so that the coins can be readily retrieved by the customer and are allowed to fall downwardly by the force of gravity.

21 Claims, 3 Drawing Sheets

COIN MECHANISM FOR VENDING MACHINE

BACKGROUND OF THE INVENTION

The present invention relates to a coin operated vending machine, and more, particularly, to a multiple coin mechanism that receives the coins for operation of the vending machine and which allows the easy recovery of coins that need to be retrieved from the machine.

The use of various vending machines is, of course, well known and there are a great variety of such machines currently in use for a wide range of products to be dispensed. In the operation of such vending machines, the products desired by the customer are located securely within the particular vending machine, albeit, sometimes on display in that vending machine for the user. Thus, the customer inserts a predetermined combination of coins to reach the aggregate sum required for the specific product whereupon a coin discriminating mechanism acts to identify the particular coins that have been inserted into a coin slot to verify that the proper amount of money has been proffered to the vending machine and that discriminating mechanism thus allows the vending machine to release the product to the user upon correct verification of the amount of money.

In such machines, there are also a wide variety of coin mechanisms that are used to allow the user to insert the proper coins as well as a wide range of discriminating mechanisms that verify the coinage and allow the release of the product. One of the present coin mechanisms currently in use comprises a housing or body that is affixed to the vending machine and which has a coin barrel that can be moved between an outer position and an inner position. In the outer position, the coin barrel extends outwardly from the body and has an upwardly facing coin receiver into which the coins are inserted vertically downwardly. Within that coin receiver, there are a number of individual coin slots that are specially sized so as to receive a particular coin.

When the customer has inserted the proper combination of coins into the coin slots, the coin barrel containing those coin is pushed inwardly by the customer to its inner position where there is located the coin discriminating mechanism. The coin discriminating mechanism thus recognizes the number and denomination of coins that the customer has inserted into the coin slots and allows the coin barrel to be rotated in a direction, generally clockwise, in order to operate the vending machine to release the desired product. If, of course, the proper coins are not inserted into the coin slots, the coin discriminating mechanism will not allow the coin barrel to rotate at all so that no product is released from the vending machine.

One of the difficulties with the aforedescribed coin mechanism is that it is extremely difficult to remove a coin from the coin slot if an error has been made in the insertion of that coin. For example, if a dime is inadvertently dropped into a coin slot intended for a quarter, the dime will still drop into the quarter coin slot but the coin discriminating mechanism will, no doubt, recognize that a quarter is not in that coin slot and will not allow the coin barrel to rotate to operate the vending machine. In such instance, while the coin barrel can be returned to its outer position and the coins within the coin slots thus are visible, it is still very difficult to remove the small coin from the large slot intended for a quarter.

Since, in the outer position, the coin barrel is movable axially but not rotatable, it requires the user to try to fish out the incorrect coin, even to the extent of requiring tweezers, in an effort to correct the problem. It is a tedious task and one that some users become frustrated and simply leave the improper coin in the slot, thereby rendering the vending machine inoperative for the next user who is faced with the same problem of trying to remove the coin that is in the improper slot. The result is frustration on the part of the customers of the vending machine and potentially considerable downtime for a vending machine that would otherwise be generating revenue.

In other situations, there are times that the customer simply changes his or her mind and decides not to purchase one of the products within the vending machine after one or more coins has been inserted into the slots. At that point, the customer is interested in retrieving all of the coins, however, the same problem persists, that is, the coins are securely with the appropriate slot for the particular coin, however there still is no easy means of retrieving those coins back to the prospective purchaser without considerable difficulty.

Thus, it would be advantageous for the coin mechanism for such a vending machine to have some means of retrieving an inadvertently, incorrectly placed coin with ease and without a great deal of maneuvering or the need to use some retrieval implement or device to aid in the recovery of the coin.

SUMMARY OF THE INVENTION

In accordance with the present invention, therefore, there is a coin mechanism provided that overcomes the difficulties and problems of the present prior art coin mechanisms by allowing the user to easily and readily retrieve coins from the coin mechanism if the customer has a change of mind or has inadvertently inserted a coin into an incorrect coin slot.

In the present invention, the coin mechanism comprises a body, preferable of a molded plastic construction having a coin barrel that is both rotatable and axially movable within that body. The coin barrel includes a coin receiver that faces vertically upwardly when located in position affixed to the vending machine. Thus, the customer can insert the coins into the coin receiver vertically downwardly. The coin receiver itself, comprises a plurality of individual coin slots, each specifically designed to accept a particular denomination of coin.

When the coins have been inserted by the customer into the coin receiver, the coin barrel can be moved axially inwardly by the customer such that the coins enter the internal, secure area of the vending machine where a coin discriminating mechanism evaluates the number and denomination of the coins to be sure that the correct aggregate amount of money has been proffered to the vending machine by the customer.

If the proper coinage has, in effect, been inserted by the user and is recognized by the coin discriminating mechanism, that mechanism releases a locking system to allow the customer to rotate the coin barrel in a first direction to operate the vending machine and thereby have the product released to the customer.

The present coin mechanism also has a advantageous feature that allows the customer to retrieve the coins that have been inserted vertically downwardly into the coin receiver in the event one or more of those coins has been inadvertently inserted into the wrong coin slot i.e. one intended for another denomination of coin, or, alternatively, the customer simply has had a change of mind and wants the coins returned. In such event, the present coin mechanism allows the customer, when the coin barrel is in its outer position, to rotate the coin barrel in a second direction such that the coin receiver faces substantially downwardly and the coins can fall out by the force of gravity, thereby making it simple and easy for the customer to retrieve the coins. In the preferred embodiment, the first direction is the clockwise direction and the second direction is the counter clockwise direction of rotation, however, the directions may be opposite that of the preferred embodiment or, as a further alternative the first and second directions may be the same direction.

In any event, with the present invention, the customer can simply rotate the coin barrel, when in its outer position, and quickly retrieve any coins that have been inserted into the coin receiver by rotating the coin barrel to a position where the coin receiver is substantially facing the downward direction so that the coins can readily fall downwardly by the force of gravity to be retrieved by the customer.

Other features of the present coin mechanism will become apparent in light of the following detailed description of a preferred embodiment thereof and as illustrated in the accompanying drawings.

DETAILED DESCRIPTION OF THE INVENTION

Figure 1:
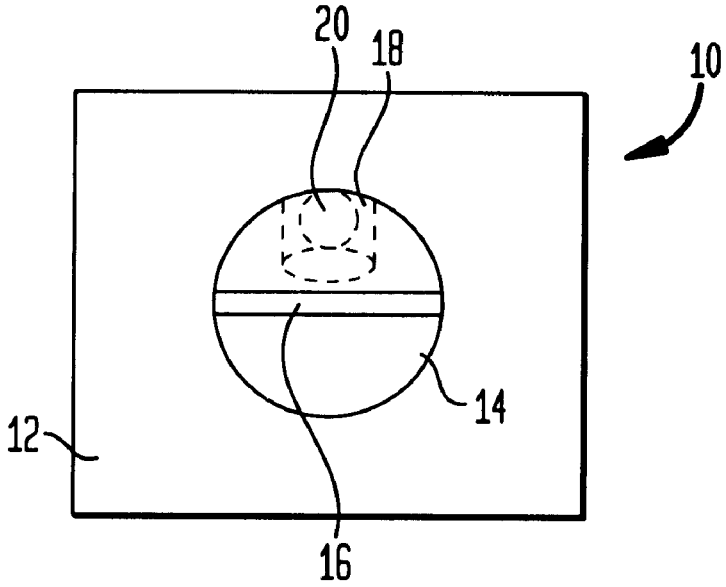
FIG. 1 is a front view of the present coin mechanism with the coin barrel in position to receive coins from the customer.
Figure 2:
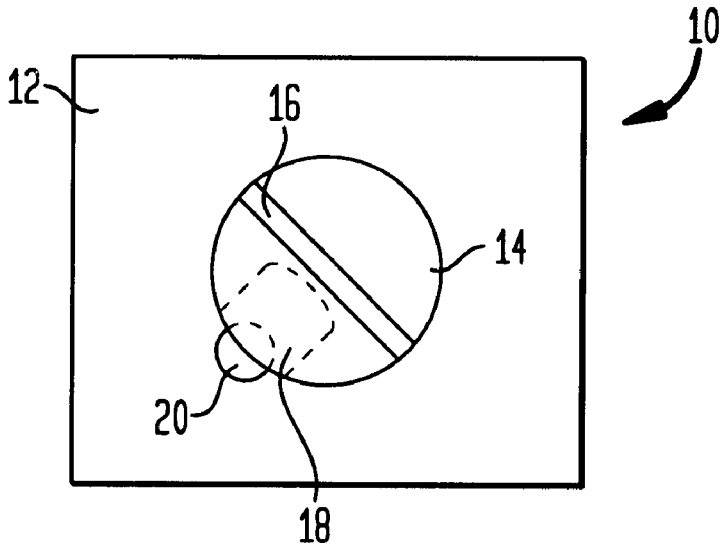
FIG. 2 is a front view of the mechanism of FIG. 1 where the coin barrel has been rotated by the customer in order to retrieve the coins from the coin barrel.

Referring now to FIGS. 1 and 2, there are shown, front views, respectively of the present coin mechanism 10 having a main housing or body 12 having rotatably positioned therein, a coin barrel 14 with an operating handle 16 extending forwardly therefrom. The coin mechanism 10 is adapted to be located in the front surface of a normal vending machine and is normally oriented such that a coin or coins can be inserted into the coin mechanism 12 in order to obtain a product from that machine. Obviously, the machine may vend any variety of products to be used by the customer including tokens, edible products or other useful products desired by the customer.

As can be seen, with the position of the coin barrel 14 as shown in FIG. 1, there is a coin receiver 18 that is oriented so as to face generally vertically upwardly so that the user can drop the desired coins into the coin receiver 18 as will be later explained. In FIGS. 1 and 2, the coin receiver 18 is shown as containing a coin 20 for purposes of illustration, however, as will later be seen, the coin receiver 18 may have a number of individual coin slots to receive a plurality of specific coins in order to operate the coin mechanism 10 and to receive a product from the vending machine.

As such, therefore, in FIG. 1, the orientation of the coin receiver 18 is such that the customer drops or inserts the coin 20 vertically downwardly into the coin receiver 18 so that the coin 20 rests within the coin receiver 18 within the coin barrel 14. As can be seen, therefore, if the customer desires to remove the coin 20 from that coin receiver 18, the coin must be physically grasped and again moved vertically upwardly. As previously outlined, that desire to remove the coin may be due to a change of mind of the customer who has decided not to make use of the vending machine or, in the alternative, where the customer has inadvertently inserted the wrong coin into a particular slot designed to accept a different coin.

In any event, the removal of the coin when in the FIG. 1 orientation of the coin receiver 18 is difficult and often requires the use of tweezers or other implements to remove the coin 20. There is thus a frustration on the part of the customer to recover the coin or the upset customer may simply abandon the effort and leave the vending machine inoperative for later customers with the consequent loss of revenue for that machine.

As can now be seen in FIG. 2, the coin barrel 14 has been rotated to a second position where the coin receiver 18 is oriented in a generally downward direction and the coin 20 can easily fall from the coin receiver 18 by the force of gravity. Thus, where the task of removing the coin 20 is a laborious job when the coin receiver 18 is oriented as shown in FIG. 1, the task is readily accomplished and easy when the coin receiver 18 is in the orientation of FIG. 2. As noted, the position of the coin receiver in FIG. 2 only needs to be sufficiently in the downward direction to allow the force of gravity to take effect and it is not necessary that the coin receiver 18 be rotated fully 180 degrees from the vertically upwardly facing orientation of FIG. 1.

Accordingly and as with the present state of the art coin mechanisms, the coin barrel 14 can be moved axially from an outer position to an inner position. In the outer position, the coin receiver 18 is exterior of the vending machine front surface or door and thus, the customer can drop or insert a coin vertically downwardly into the coin receiver 18 in accordance with the orientation of FIG. 1. The coin barrel 14 can then be pushed axially inwardly with respect to the front door or surface of the vending machine so that the coin receiver 18, along with the coins contained therein, are moved to a secure location within the interior of the vending machine at which point, the coin barrel 14 can be rotated, generally clockwise, providing the proper coins are in the locations designated for those coins, and the vending machine is activated to release the particular selected product to the customer. As also is obvious, at that point, with the coin barrel 14 in the inner position and rotated, the coins are deposited into the interior of the vending machine and thus are irretrievable by the customer since the vending machine is, at that point, providing the selected product to the customer.

With the present prior art coin mechanism, however, the coin barrel 14 cannot be rotated while in the outer position but for a minute limited movement; in effect, the limited rotational movement prevents the coin barrel 14 from being rotated to any position where the force of gravity can free the coins from the coin receiver 18. With the present state of the art, movement of the coin barrel 14 to the position of FIG. 2 is not possible when the coin barrel 18 is in its outer position so the customer, as explained, is unable to easily retrieve a coin from the coin receiver 18.

Thus, with the present invention, there is a coin mechanism 10 that allows the customer to rotate the coin barrel 14 containing the coins to a position where the coins can be easily removed by that customer or which can basically fall from the coin receiver 18 by the force of gravity, a function that is not possible with the operation and construction of the current prior art coin mechanisms.

Figure 3:
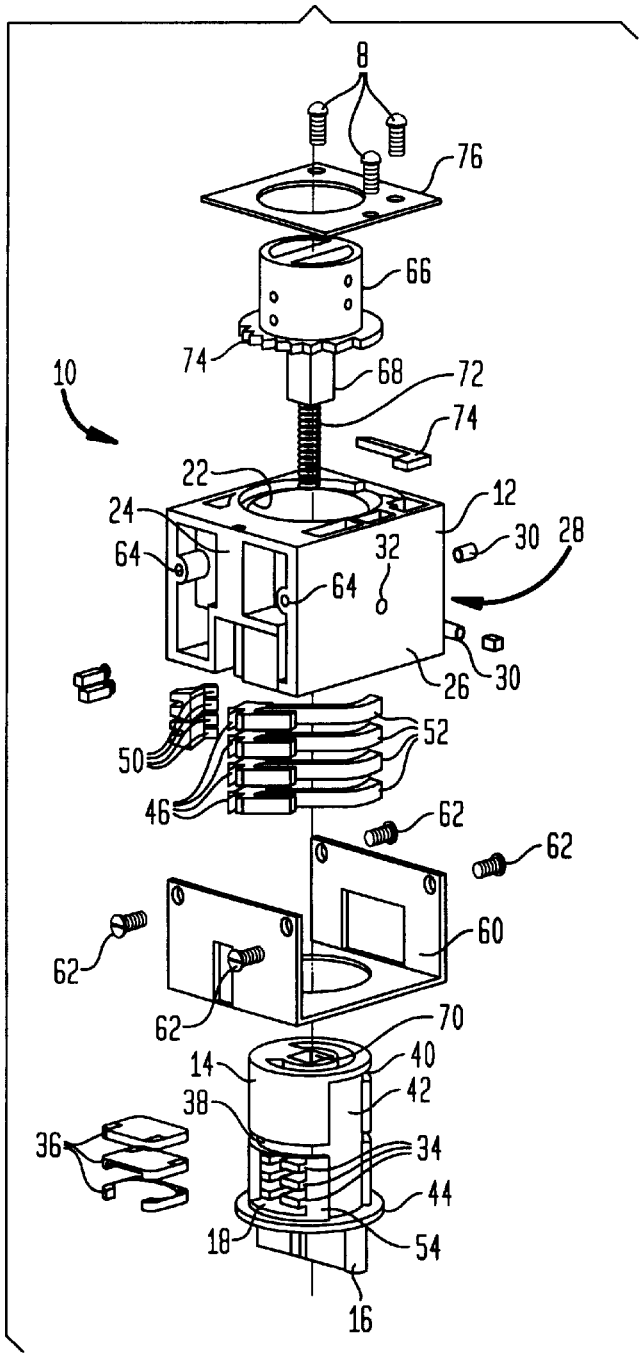
FIG. 3 is an exploded view of the present coin mechanism showing the individual components used in carrying out the present invention.
Figure 3A:
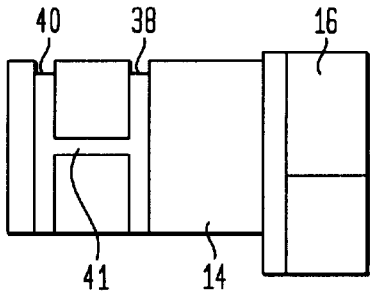
FIG. 3A is a bottom plan view of one of the components used in carrying out the present invention.

Turning now to FIG. 3, there is shown an exploded view of the coin mechanism 10 constructed in accordance with the present invention and to FIG. 3A there is a bottom plan view of the coin barrel 14. As can be seen in FIG. 3, the coin mechanism 10 includes a housing or main body 12 that is preferably made of a molded plastic material and which has an internal circular opening 22 sized so as to receive the coin barrel 14 therein and allow the coin barrel 14 to move therein. For convention, the body 12 will be referred to as having an upper surface 24 that is oriented in the upwardly facing position when the coin mechanism 10 is installed in a vending machine.

Accordingly, by the same convention, there is a side surface 26 and a rear surface 28 and a pair of alignment pins 30 that enter the body 12 though holes 32 in the side surface 26 and the rear surface 28 (only the hole 32 in the side surface 26 is shown), and the alignment pins are therefore preferably at about 90 degrees apart around the periphery of the body 12 and serve, as will be explained, to retain and stabilize the coin barrel 14 when installed within the internal circular opening 22 of the body 12.

Taking next the coin barrel 14, it also is preferably a plastic molded construction and has the operating handle 16 extending outwardly therefrom to be gripped by the customer in the operation of the coin mechanism 10. As also can be seen, the coin receiver 18 is formed in the upper surface of the coin barrel 14 such that, when installed in the vending machine, the coins to be inserted into the coin receiver 18 are dropped or inserted vertically downwardly into the coin receiver 18 by the customer. The coin receiver 18 has a plurality of coin slots 34 formed therein and which are adapted to individually receive the coins that are deposited into the coin receiver 18. A price plug 36 can be inserted into each of the coin slots 34 and there are differing price plugs 36 depending upon the denomination of the particular coin that will be accepted into a coin slot 34 to allow the coin mechanism 10 to operate.

In particular, there may be a price plug 36 for a quarter, dime and nickel and, depending upon the amount of money required for a particular item to be dispensed by the vending machine, the customer must insert the proper coin into the proper coin slot 34, as determined by the price plug 36 located in that coin slot 34 to properly operate the coin mechanism 10. As will be seen, the purpose of the individual price plugs 36 inserted into individual coin slots 34 is to bring the height of the individual coins up to a generally uniform height so that all of the coins, if in the proper location, are positioned with the upper edges of the coins, no matter what the denomination of the coin itself, at about the same height within the coin receiver 18. Therefore, depending upon the particular price for the article to be vended by means of the vending machine, there will be one or more price plugs 36 inserted into the coin slots 34 to make up that price.

The coin barrel 14 further has an annular central groove 38 formed in the periphery thereof and which surrounds the entire 360 degrees of that periphery. An inner end groove 40 is also form on the periphery of the coin barrel 14 and which extends a angular degree around that periphery of less than 360 degrees but in excess of 180 degrees and the purpose of the inner end groove 40 will be later explained.

Next, there is an axially oriented indented area 42 formed on the periphery of the coin barrel 14 having a predetermined width and which spans from a front circular flange 44 to the inner end groove 40. A further axially aligned groove 41 (shown only in FIG. 3A) is formed in the periphery of the coin barrel 14 and is located at the bottom surface of the coin barrel 14 and extends between the central groove 38 and the inner end groove 40.

In the assembly of the coin mechanism 10, the coin barrel 14 is interfitted within the circular opening 22 in the body 12 and the alignment pins 30 are inserted so as to fit into the grooves of the coin barrel 14. In the position as shown, where the coin receiver 18 is located so as to face vertically upwardly, the alignment pin 30 in the side surface 26 of the body 12 is located in the axial indented area 42 and the other alignment pin 30 inserted into the rear surface 28 of the body 12 enters the further axially aligned groove 41. As such, the coin barrel 14 is free to move axially within the body 12 between an outer position where the alignment pins 30 are aligned with inner end groove 40 and an inner position where the coin barrel 12 can be pushed inwardly into the body 12 such that the alignment pins 30 are then aligned with the inner end groove 40. Due to the 90 degree spacing of the alignment pins 30, one of such alignment pins 30 rides within the further axially aligned groove 41 and the other alignment pin 30 rides within the indented area 42.

Thus, as can be seen, when the coin barrel 14 is in its inner position, the alignment pins 30 are located within and ride along the central groove 38 and the coin barrel 14 can be rotated a full 360 degrees (but for a further restraint that will be later explained) and when the coin barrel 14 is in its outer position the alignment pins 30 are both located within and ride along the inner end groove 40 such that the coin barrel 14 can be moved more than about 90 degrees but less than 180 degrees, preferably about 95 degrees, as determined by the inner end groove 40 and the extent to which it is formed about the periphery of the coin barrel 14.

As also shown, the inner end groove 40 is formed to be more than 180 degrees but less that 360 degrees about the periphery of the coin barrel 14 to allow the coin barrel 14 to rotate to the desired degree in the counterclockwise direction from the position shown in FIG. 3 such that the coin barrel 14 can be moved as shown in FIGS. 1 and 2 and as previously explained and the coin barrel 14 rotated by the user sufficiently in the counter clockwise direction so as to release the coins located within the coin receiver 18 to fall out of the coin mechanism 10. As stated, that rotational movement is more than 90 degrees so that the coins can fall by gravity downward but need not be rotatable a full 180 degrees where the coin receiver 18 would be facing directly downwardly. As is clear, if, of course, if only one alignment pin 30 is used, the inner end groove 40 only needs to be formed in the outer peripheral surface of coin barrel 14 in excess of 90 degrees, however, the use of two pins 30 is preferred in order to have stability to the mechanism in the rotation of the coin barrel 14.

A coin discriminator mechanism is also present in FIG. 3 and which determines whether the proper number and denominations of coins have been inserted by the customer in coin receiver 18 in order for the customer to rotate the coin barrel 14 in the clockwise direction, when in its inner position, to release a product from the vending machine. To that end, there are a plurality of fingers 46 that ride within the indented area 42 so as not to hamper the movement of the coin barrel 14 in an axial direction between its inner and outer positions but do effect any attempt to move the coin barrel 14 by rotation.

Each finger 46 is held or biased against that indented area 42 by means of a plurality of leaf springs 50 that bear against the fingers 46 to create that bias. At the free ends of the fingers 46 there is a locking tab 52 that actually rides along the indented area 42 and locks against the raised ridge 54 formed as a result of the indented area 42. Since the leaf springs 50 are firmly fixed with respect to the body, the locking tabs 52, when in the position riding within the indented area 42 engage the raised ridge 54 and prevent the rotational movement of the coin barrel 14 except for a very limited movement allowed by the width of the indented area 42.

Figure 4A:
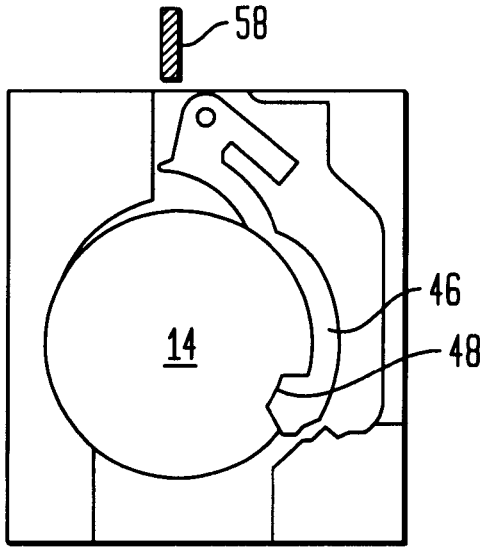
FIGS. 4A and 4B are side schematic views showing the locking mechanisms of the present invention showing a feature of the present coin mechanism in more detail.
Figure 4B:
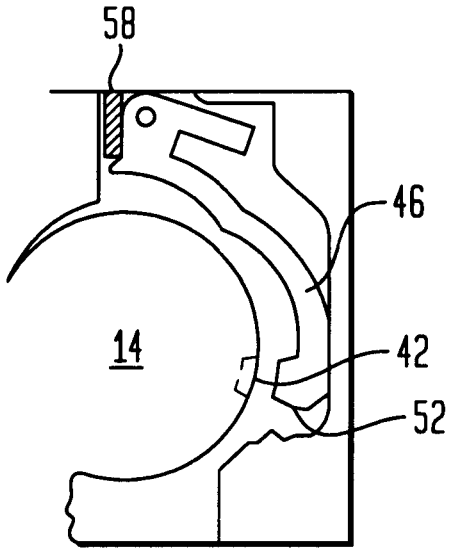

Turning briefly now to FIGS. 4A and 4B, there is a schematic view illustrating the action of the fingers 46 that engage the coin barrel 14. In FIGS. 4A and 4B, there can be seen that the fingers 46 are pivotally affixed to the body 12 by means such as pins 58 so that the locking tabs 48 can move as the fingers 46 rock in order to engage and disengage to the indented area 42 of the coin barrel 14. As such, in FIG. 4A, the locking tabs are within the indented area 42 and the coin barrel 14 cannot be rotated in the clockwise direction. In FIG. 4B, a block out pin 58 has been inserted that physically moves the finger 46 and, if course, the locking tab 52 is no longer engaging the indented area 42 and the raised ridge 54 and thus, in the event there is a coin slot 34 (FIG. 3) for which no coin is needed to meet the price of the particular item desired by the user, a block out pin 58 can be inserted to disengage that specific finger 46 and its corresponding locking tab 52 to render that coin slot 34 as unnecessary and no coin need be inserted into that slot to operate the vending machine and receive that item.

FIGS. 4A and 4B, taken along with FIG. 3, also illustrate the effect where a proper coin has been inserted into a coin slot 34. As previously explained, the use of the price plugs 36 will bring the upper edge of a coin to a uniform height with respect to any other properly inserted coin and, when the customer pushes the coin barrel 14 into its inner position, the coins are generally in alignment with the fingers 46 such that each finger 46 is aligned with one of the coins.

Thus, as the customer rotates the coin barrel 14 in the clockwise direction, the edge of each coin at the proper height will engage the corresponding finger 46 and lift that finger from its engagement within the indented area 42 so that the locking tabs 48 of the fingers 46 will clear the raised ridge 54 and the coin barrel 14 can be moved in the clockwise direction to releases the particular product or item from the vending machine. If, as can be seen, any other coin is not present or is in the improper coin slot 34, the corresponding finger 46 will not be disengaged and the coin barrel will be prevented by that finger from rotating in the clockwise direction and the customer will be unable to operate the vending machine and to receive the desired product.

Accordingly, in summary, when the customer has inserted the proper number and denominations of coins vertically downwardly into the coin receiver 18, the coin barrel 14 can be moved axially inwardly by the customer from its outer position where the coin receiver 18 is accessible, to the inner position where the coin receiver is within the confines of the vending machine and the coin receiver 18 enters the coin discriminator mechanism where the coins are basically checked to make sure they are correct and, if so, allow the customer to rotate the coin barrel 14 in the clockwise direction to operate the vending machine to receive the desired product. If, on the other hand, the customer has had a change of mind or has improperly inserted the wrong coin into one of the coin slots, the customer can simply rotate the coin barrel 14, while still in the outer position, and the coin receiver 18 can be rotated in the counterclockwise direction to a position where the coins can be removed, even by the normal force of gravity so that the customer can easily retrieve the coins from the coin receiver.

As further components in the coin mechanism 10, there is a front plate 60 that is affixed to the body 12 to maintain and protect all the internal parts in the proper position and that affixation may be by means of screws 62 that enter threaded bosses 64 formed in the plastic molded body 12. A ratchet 66 is affixed to and rotates with the coin barrel 14 and includes a square driver 68 that enters a correspondingly shaped square opening 70 in the coin barrel 14 and a spring 72 is positioned between the ratchet 66 and the coin barrel 14 to exert a bias against the coin barrel 14 to bias the coin barrel 14 toward its outer position.

The rotation of the ratchet 66 in the clockwise direction carries out the operation of the vending machine and the later vending machine mechanisms to release the particular product are conventional, it being seen that the ratchet 66 is only allowed to rotate in the clockwise direction by means of an anti-reverse dog 74 that acts upon a plurality of directionally oriented serrated teeth 74 formed on the ratchet. Again, a back plate 76 covers the back surface of the body 12 and can be affixed thereto to by screws 78 that interfit into threaded holes formed in the body 12.

Accordingly, as can be now seen, with the use of the present coin mechanism the coin barrel 14 is movable axially between outer and an inner positions. When in the outer position, the coin barrel 14 can now be rotated by the user to a position where the coin or coins can be easily removed from that coin barrel 14 without any extensive manipulations to retrieve the coins. The present coin mechanism is thus an improvement over the conventional coin mechanisms where the retrieval of a coin required some implement or extensive labor to remove the coin from the vertically oriented coin receiver since those prior mechanisms did not allow the coin receiver to rotate to a position where gravity can aid in the coin removal.

It will be understood that the scope of the invention is not limited to the particular embodiment disclosed herein, by way of example, but only by the scope of the appended claims.

We claim:

1. A coin mechanism for a vending machine, said coin mechanism comprising:

a body adapted to be affixed to a vending machine, a coin barrel affixed to said body and having a coin receiver orientated so as to receive one or more coins inserted vertically downwardly into said coin receiver by a user, said coin barrel having an outer position wherein the coins can be inserted into said coin receiver and an inner position wherein said coin receiver is contained within said body, said coin barrel being biased toward said outer position, a coin discriminating mechanism contained within said body and adapted to allow said coin barrel to be rotated in a first direction to operate the vending machine when the correct coins are inserted in said coin receiver and said coin barrel is in said inner position, said coin barrel being movable in a second direction when in said outer position sufficiently to orient said coin receiver facing substantially downwardly to cause coins present in said coin receiver to fall downwardly from said coin receiver by gravitational force.

2. A coin mechanism as defined in claim 1 wherein said first direction is the clockwise direction.

3. A coin mechanism as defined in claim 1 wherein said second direction is the counter clockwise direction.

4. A coin mechanism as defined in claim 1 wherein said first and said second directions are the same direction.

5. A coin mechanism as defined in claim 1 wherein said coin barrel is biased toward said outer position.

6. A vending machine for vending products as defined in claim 1 wherein said movement of said coin barrel in said second direction is determined by a groove formed in the outer peripheral surface of said barrel.

7. A vending machine for vending products as defined in claim 6 wherein said groove extends at least 90 degrees about the outer peripheral surface of said coin barrel.

8. A vending machine for vending products as defined in claim 7 wherein said mechanism includes at least one pin affixed to said body and adapted to be located with and ride along said groove.

9. A vending machine for vending products as defined in claim 8 wherein said at least one pin comprises a pair of pins space 90 degrees apart and said groove extends at least 180 degrees around the outer periphery of said coin barrel.

10. A coin mechanism as defined in claim 1 wherein said coin receiver comprises a plurality of coin slots each adapted to receive a specific denomination of coin.

11. A coin mechanism for a vending machine, said coin mechanism comprising:

a body adapted to be affixed to a vending machine, a coin barrel affixed to a housing and having a coin receiver orientated so as to receive one or more coins inserted vertically downwardly into said coin receiver by a user, said coin barrel having an outer position wherein the coins can be inserted into said coin receiver and an inner position wherein said coin receiver is contained within said body, said coin barrel being biased toward said outer position, said coin barrel further having an annular central groove and an inner end groove formed therein at least one alignment pin affixed to said body and adapted to be positioned so as to enter said annular central groove said coin barrel is in said inner position and said at least on alignment pin is adapted to enter said inner end groove when said coin barrel is in said outer position, said central groove adapted to be formed 360 degrees about said coin barrel and said inner end groove is adapted to be formed in excess less than about 360 degrees about said coin barrel, a coin discriminating mechanism contained within said body and adapted to allow said coin barrel to be rotated in a first direction to operate the vending machine when the correct coins are inserted in said coin receiver and said coin barrel is in said inner position, said coin barrel being movable in a second direction when in said outer position an amount determined by the degrees of rotation allowed by the movement of said at least one alignment pin contained within said inner end groove to orient said coin receiver facing substantially downwardly to cause coins present in said coin receiver to fall downwardly from said coin receiver by gravitational force.

12. A coin mechanism for a vending machine as defined in claim 11 where said at least one alignment pin comprises two alignment pins spaced about 90 degrees apart about said coin barrel.

13. A coin mechanism for a vending machine as defined in claim 11 wherein said inner end groove extends more than about 90 degrees about said coin barrel.

14. A vending machine for vending products, said vending machine comprising a front surface and a coin mechanism mounted to said vending machine, said coin mechanism, comprising a body affixed to said vending machine interior of said front surface, a coin barrel affixed to said body and having a coin receiver orientated so as to receive one or more coins inserted vertically downwardly into said coin receiver by a user, said coin barrel having an outer position wherein the coins can be inserted into said coin receiver and an inner position wherein said coin receiver is contained within said body, said coin barrel being biased toward said outer position, a coin discriminating mechanism contained within said body and adapted to allow said coin barrel to be rotated in a first direction to operate the vending machine when the correct coins are inserted in said coin receiver and said coin barrel is in said inner position, said coin barrel being movable in a second direction when in said outer position sufficiently to orient said coin receiver to face substantially downwardly to cause coins present in said coin receiver to fall downwardly from said coin receiver by gravitational force.

15. A vending machine for vending products as defined in claim 14 wherein said coin barrel is movable in said second direction at least 90 degrees.

16. A vending machine for vending products as defined in claim 15 wherein said first direction is clockwise and said second direction is counterclockwise.

17. A vending machine for vending products as defined in claim 16 wherein said coin mechanism includes at least one pin adapted to be located within and ride along said groove.

18. A vending machine for vending products as defined in claim 17 wherein said at least one pin comprises a pair of pins located about 90 degrees apart.

19. A vending machine for vending products as defined in claim 18 wherein said groove extends at least 180 degrees about the peripheral surface of said coin barrel.

20. A vending machine for vending products as defined in claim 14 wherein said movement of said coin barrel in said second direction is determined by a groove formed in the outer peripheral surface of said coin barrel.

21. A vending machine for vending products as defined in claim 20 wherein said groove is formed in said outer peripheral surface of said coin barrel of at least 90 degrees.

* * * * *